US007452446B2

(12) United States Patent
Hermans et al.

(10) Patent No.: US 7,452,446 B2
(45) Date of Patent: Nov. 18, 2008

(54) APPARATUS AND METHOD FOR DEWATERING A FABRIC

(75) Inventors: Michael Alan Hermans, Neenah, WI (US); Frank Stephen Hada, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 400 days.

(21) Appl. No.: 11/252,522

(22) Filed: Oct. 18, 2005

(65) Prior Publication Data

US 2007/0084576 A1 Apr. 19, 2007

(51) Int. Cl.
*D21F 1/32* (2006.01)

(52) U.S. Cl. ..... 162/199; 162/272; 162/274; 162/275

(58) Field of Classification Search ..... 162/199, 162/272, 274, 275, 202
See application file for complete search history.

(56) References Cited

U.S. PATENT DOCUMENTS

| | | | | |
|---|---|---|---|---|
| 3,347,740 | A * | 10/1967 | Goumeniouk | 162/199 |
| 4,270,702 | A | 6/1981 | Nicholson | |
| 5,598,643 | A | 2/1997 | Chuang et al. | |
| 5,699,626 | A | 12/1997 | Chuang et al. | |
| 5,701,682 | A | 12/1997 | Chuang et al. | |
| 6,451,171 | B1 | 9/2002 | Jewitt | |
| 2004/0069432 | A1 | 4/2004 | Hansen | |
| 2005/0204580 | A1 | 9/2005 | Jewitt | |

FOREIGN PATENT DOCUMENTS

| | | | |
|---|---|---|---|
| CA | 886 309 | A | 11/1971 |
| EP | 0 936 304 | A2 | 8/1999 |
| FR | 1 373 102 | A | 9/1964 |
| GB | 962 331 | A | 7/1964 |
| WO | WO 01/44565 | A1 | 6/2001 |
| WO | WO 02/48453 | A1 | 6/2002 |

* cited by examiner

*Primary Examiner*—Mark Halpern
(74) *Attorney, Agent, or Firm*—Gregory E. Croft

(57) ABSTRACT

A fabric dewatering apparatus for use after a fabric cleansing apparatus in a paper machine including: an endless wicking substrate disposed for rotation about a dryer roll; the endless wicking substrate and the fabric brought into surface contact as the fabric traverses at least a portion of the dryer roll's circumference; and a wicking substrate dewatering apparatus disposed along the wicking substrate's travel path after the dryer roll.

24 Claims, 3 Drawing Sheets

APPARATUS AND METHOD FOR DEWATERING A FABRIC

BACKGROUND

In the manufacture of paper, various fabrics are used to form, dewater, mold, dry, support, and/or transfer the paper web from the headbox to the reel. During the operation of the paper machine, these fabrics often become dirty, contaminated with residual fibers, or contaminated with residual chemicals. As a result, fabric cleaning apparatuses such as flooded nip showers, scarfing showers, high pressure fan jets, needle showers, and the like are used to remove the contaminants. This process can leave the fabric relatively wet after being sprayed by water, which is typically, used as the cleaning agent. For applications where the fabric operates in a wet environment, such as the forming section, the retained moisture on the fabric after the cleaning process poses few, if any, issues. However, for fabrics which need to be relatively dry to carry out their intended function, or for fabrics that carry the paper web through the drying section, the retained water can cause operational issues or significantly increase the drying costs required to evaporate the retained moisture on the fabric after the cleaning operation.

Typically, fabrics operating in the dryer section of the paper machine are dewatered after cleaning by the use of a vacuum box, an air knife, or an air shower to blow the excess water from the fabric. Vacuum has the disadvantage of being the most expensive of these options to produce and is limited in differential pressure obtainable by the available atmospheric pressure. The air knife can have several drawbacks when used for dewatering the cleaned fabric. First, compressed air is relatively expensive and the operation of one or more air knives can consume a large amount of energy when used to dewater the fabric. Second, an air knife is only partially effective in removing all of the retained water in the fabric after cleaning. Additionally, air knives and vacuum boxes can create drag on the fabric surface, which increases the fabric's wear rate, thereby reducing the fabric's life.

Therefore, what is needed is a fabric dewatering apparatus and method that consumes less energy. Also, what is needed is a fabric dewatering apparatus and method that removes more retained moisture from the fabric.

SUMMARY

The inventors have determined that the above problems and needs can be met by a fabric dewatering device that uses a wicking substrate, such as a felt, that is brought into contact with the wet fabric after the fabric has been cleaned. The felt can be used as the only method of dewatering the cleaned fabric, or the felt can be used in conjunction with an air knife or other apparatus for removing water from the cleaned fabric.

Thus, in one embodiment, the invention resides in a fabric dewatering apparatus for use after a fabric cleaning apparatus in a paper machine including: an endless wicking substrate disposed for rotation about a dryer roll; the endless wicking substrate and the fabric brought into surface contact as the fabric traverses at least a portion of the dryer roll's circumference; and a wicking substrate dewatering apparatus disposed along the wicking substrate's travel path after the dryer roll.

Thus, in another embodiment, the invention resides in a method of dewatering a fabric comprising contacting the fabric with an endless wicking substrate.

BRIEF DESCRIPTION OF THE DRAWINGS

The above aspects and other features, aspects, and advantages of the present invention will become better understood with regard to the following description, appended claims, and accompanying drawings where:

Figure 1:
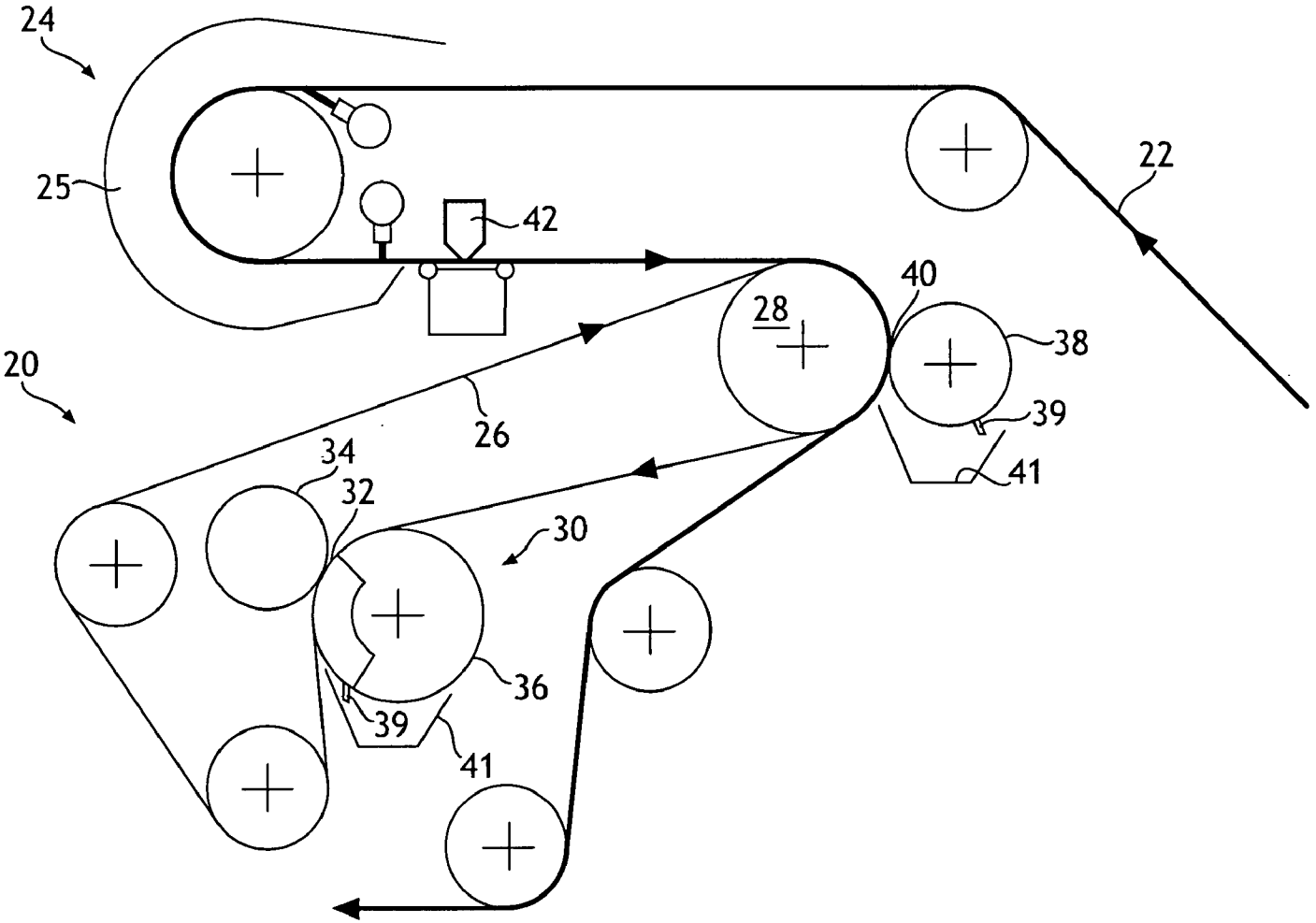
FIG. 1 illustrates one embodiment for a fabric dewatering apparatus.

Repeated use of reference characters in the specification and drawings is intended to represent the same or analogous features or elements of the invention.

DETAILED DESCRIPTION

It is to be understood by one of ordinary skill in the art that the present discussion is a description of exemplary embodiments only and is not intended as limiting the broader aspects of the present invention, which broader aspects are embodied in the exemplary construction.

Referring to FIG. 1, a fabric dewatering apparatus 20 is illustrated. Prior to being dewatered, a fabric 22 is cleaned by a fabric cleaning apparatus 24 such as a flooded nip shower, a scarfing shower, a high pressure fan jet, a needle shower, or combinations of various showers and the like. In the illustrated embodiment, a flooded nip shower 25 is utilized, but other fabric cleaning apparatus as known to those of skill in the art can be used. Sometime after the fabric 22 leaves the fabric cleaning apparatus 24, the fabric 22 is brought into surface contact with an endless wicking substrate 26 such as a felt. One method of accomplishing the surface contact is by wrapping both the fabric 22 and the felt 26 about a drying roll 28 with the felt contacting the surface of the dryer roll. While the felt and fabric are in surface contact, the fabric is dewatered by the felt. Thereafter, the felt and fabric diverge as the fabric is returned to the start of its run through the paper machine.

After the fabric and felt diverge, the felt is dried by a wicking substrate dewatering apparatus 30 disposed along the wicking substrate's travel path after the dryer roll 28. The felt dewatering apparatus 30 can be any commonly known device for removing water from the felt 26, such as a dryer, a blower, a vacuum device, an air knife, or a pressure roll nip. A preferred felt dewatering apparatus is a pressure roll nip 32 having a felt pressure roll 34 and a felt vacuum roll 36. A pressure roll nip is a relatively low cost method of dewatering the felt as compared to other methods. However, depending on whether the objective is to save energy in dewatering the fabric 22 or to increase productivity of the paper machine by removing as much water from the fabric 22 as possible, more expensive methods of drying the felt can be used. After the felt dewatering apparatus 30, the felt 26 is guided and tensioned by suitable rolls, as known to those of skill in the art, to return the felt to its entry point on the drying roll 28.

In one embodiment of the invention, the fabric's pressure alone, by being wrapped about the drying roll 28, is sufficient to dewater the fabric 22. For example, a typical fabric tension can be on the order of 20 pounds per inch while a typical drying roll can have a radius of approximately 18 inches. Thus, the surface pressure the fabric 22 exerts on the felt 26 as it is directed about the drying roll 28 is equal to T/R or approximately 1 psi. The felt and the fabric can be brought into contact for a sufficient period of time by providing a sufficient wrap angle on the drying roll 28. The wrap angle can be varied from a relatively small angle to a substantially large angle to achieve the desired dwell time by varying the both the wrap angle and the drying roll's radius. During the fabric's surface contact with the felt, the fabric is dewatered as it traverses the periphery of the drying roll 28 as determined by the wrap angle.

Surprisingly, the inventors have determined that a felt can be used to dewater a fabric. Previously, felts have been used to dewater a paper web by sandwiching the paper web between a Yankee dryer on one side and a felt backed by a pressure roll on the opposite side. In the wet pressed process, an extremely high nip load such as 400 pli is used to force the water from the paper web into the felt. The high nip load compresses the weak paper web and squeezes the water from the paper web into the felt. In contrast, the fabric wrap on the dryer roll used by the inventors has a significantly lower loading pressure. Additionally, the fabric is relatively incompressible when compared to the water saturated paper web of the wet pressed process. Since the fabric pressure on the felt is so low and since the fabric is relatively incompressible in comparison to the wet pressed process, it was unexpected that the felt in surface contact with the fabric would adequately dewater the fabric.

The endless wicking substrate 26 can contact either side or even both sides of the fabric 22 (paper web contacting surface or paper machine contacting surface) and will generally be placed to contact the side of the fabric side having more retained water. For example, gravity may bias more water to one side, or an air knife or vacuum box may bias more water to one side. Centrifugal force may bias more water to one side of the fabric as disclosed in U.S. patent application 2005/0204580 dated Sep. 22, 2005, by Jewitt entitled *Apparatus For Conditioning A Fabric In A Papermaking Machine And Associated Method*, herein incorporated by reference. As such, it is possible to reverse the orientation of the fabric 22 and the endless wicking substrate 26 as they traverse the periphery of the drying roll 28 by using a lead in and/or an exit roll, or other method, to wrap both the fabric and the wicking substrate about the circumference of the drying roll similar to the path of the fabric about a through air dryer in a paper machine. In this manner, the fabric will contact the drying roll's 28 surface and the wicking substrate will wrap the fabric under tension dewatering the fabric with the aid of centrifugal force, thereby moving the water towards the wicking substrate. The endless wicking substrate may also be selected to contact the more open or coarse side of the fabric and the retained water may be preferentially directed to this side by the above methods.

In another embodiment of the invention, an optional fabric pressure roll 38 can be used to create a fabric nip 40 to increase the fabric's pressure contact with the felt on the drying roll 28. The fabric pressure roll 38 can be used to promote increased surface contact between the felt and fabric. The fabric pressure roll can be especially helpful for highly three-dimensional fabrics having an undulating surface topography to ensure the wicking substrate 26 engages more surface area of the fabric. Suitable loads for the fabric pressure roll 38 to enhance dewatering are between about 50 lb/in to about 400 lb/in, or between about 50 lb/in to about 200 lb/in.

A doctor blade 39 can be provided to doctor the fabric pressure roll 38 to remove loose fibers and/or water from the roll, reducing rewet of the fabric 22 and/or felt 26. A suitable pan 41 can be provided to capture and divert the water and fibers from dripping onto the fabric 22, the paper web, or other portions of the paper machine, which can cause operational issues, such as holes in the paper web, leading to web breaks.

Figure 2:
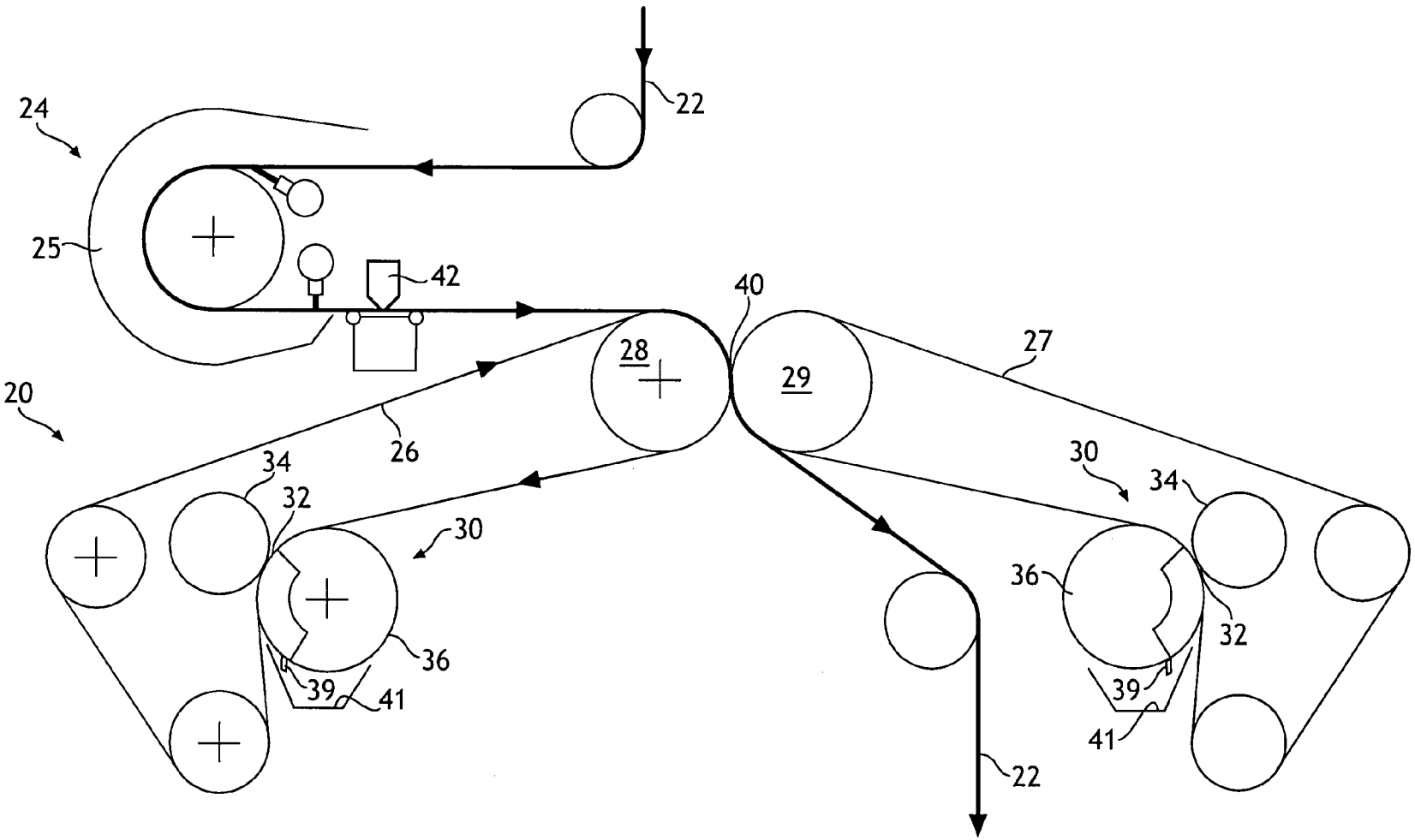
FIG. 2 illustrates an alternative embodiment of the fabric dewatering apparatus.

In another embodiment of the invention, a second drying roll 29 can be used in place of the fabric pressure roll 38 and a second wicking substrate (felt) 27 can be wrapped about the second drying roll and brought into contact with the opposite surface of the fabric 22 as shown in FIG. 2. The two drying rolls and felts can be nipped together with the fabric 22 disposed between them to dewater both sides of the fabric. The nip load can be the same ranges as discussed above for the fabric pressure roll 38. The fabric 22 can be sent through the fabric nip 40 with little to no wrap about the drying rolls. Alternatively, the fabric may wrap only one of the drying rolls and be in line contact with the other felt similar to FIG. 1. Desirably, the fabric 22 also wraps at least a portion of the second drying roll 29 as shown. In this mode, the fabric 22 will have an S-wrap as it traverses the path through the nipped drying rolls (28, 29 ). The amount of wrap on each drying roll may be dictated by the relative two-sidedness of the fabric and need not be approximately equal as shown. More wrap may be desired on the side of the fabric that is coarser to promote more dwell time for water removal. Both felts would then be subsequently dewatered by the felt dewatering apparatus 30, guided and returned to the fabric nip 40.

In various embodiments of the invention, the wrap angle of the fabric 22 about the dryer roll 28 or rolls (28 and 29 ) can be between about 0 degrees to about 300 degrees, or between about 10 degrees to about 270 degrees, or between about 10 degrees to about 200 degrees.

In another embodiment of the invention, an air knife 42 and/or vacuum box can be retained for use in dewatering the fabric 22 along with the fabric dewatering apparatus 20. The air knife and/or vacuum box can be used either before or after the fabric dewatering apparatus along the fabric's travel path. In one embodiment, the air knife 42 is located after the fabric dewatering apparatus 20 since the fabric dewatering apparatus may be more efficient in removing larger quantities of water immediately after the flooded nip shower 25 than the air knife. However, depending on the fabric's design or texture, it can be beneficial to locate the air knife 42 before the fabric dewatering apparatus 20 and to operate the air knife at a reduced pressure. Each fabric dewatering element (fabric dewatering apparatus 20, air knife 42, or vacuum box) needs to be evaluated to determine the best location and operating condition of the element that results in the lowest water content of the fabric and/or lowest energy usage.

Without the help of the fabric dewatering apparatus 20, an air knife 42 can consume about 400-500 kW of electricity for a typical 140-inch wide tissue machine. Dewatering the fabric 22 using only an air knife 42 without the fabric dewatering apparatus 20 can be an expensive solution. The fabric dewatering apparatus 20 can be used as a low cost method to remove water from the fabric 22. This may be desirable for paper machines that are not dryer limited in order to save energy in the form of compressed air. For paper machines that are dryer limited, an air knife 42 may also be employed along with the fabric dewatering apparatus 20 to remove as much water as possible from the fabric 22 in order to gain additional paper tons by reducing the dryer load required to dry the retained moisture in the fabric.

The endless wicking substrate 26 can be any substrate that pulls or absorbs water from the fabric 22. In general, the pore size of the wicking substrate will be smaller than the effective channel size of the fabric 22 to remove water by capillary action when brought into contact with the fabric. As fabrics can have complex weaves, the effective channel size refers to the between-yarn openings in the fabric adjacent to the wicking substrate that can serve to hold water due to capillary forces. A preferred wicking substrate would have a large void volume for holding water and small pores in contact with the fabric. Suitable wicking substrates can include fabrics with the correct pore size, felts typically used in the paper industry such as press felts, press felts with additional nap on the surface, and capillary membranes as referred to in the following patents: U.S. Pat. Nos. 5,598,643, 5,699,626 and 5,701,682, all herein incorporated by reference. Preferred wicking substrates include felts having a small pore size in contact with the fabric and high water carrying capability that are moldable, or have additional nap to allow intimate contact between the felt and the fabric, and that are resistant to the desired operating nip loads. The ability of the felt to better conform to the topographical features of a fabric is beneficial as this allows more opportunity for the water to move into the felt in the shortest possible time.

The drying roll 28 can be any suitable roll for wrapping the fabric 22 about the felt 26 supported by the drying roll and to bring the two into surface contact as the fabric traverses at least a portion of the dryer roll's circumference. In general, the diameter of the drying roll will be dictated by the loads imposed on the roll, the length of the roll, the desired dwell time for the fabric to contact the felt, and the wrap angle of the fabric about the roll. Suitable roll diameters are selected to limit deflection of the roll, which is influenced by the fabric's tension and the machine's width. Typical roll diameters can be between about 18 inches to about 36 inches in diameter. Since dryer roll 28 is wrapped by both the fabric 22 and the felt 26, the tension of the two together needs to be taken into consideration in the design of the roll. Doctoring by use of a doctor blade 39 and optional pan 41 may be required on fabric pressure roll 38, depending on the amount of water that is required to be removed from the fabric.

Figure 3:
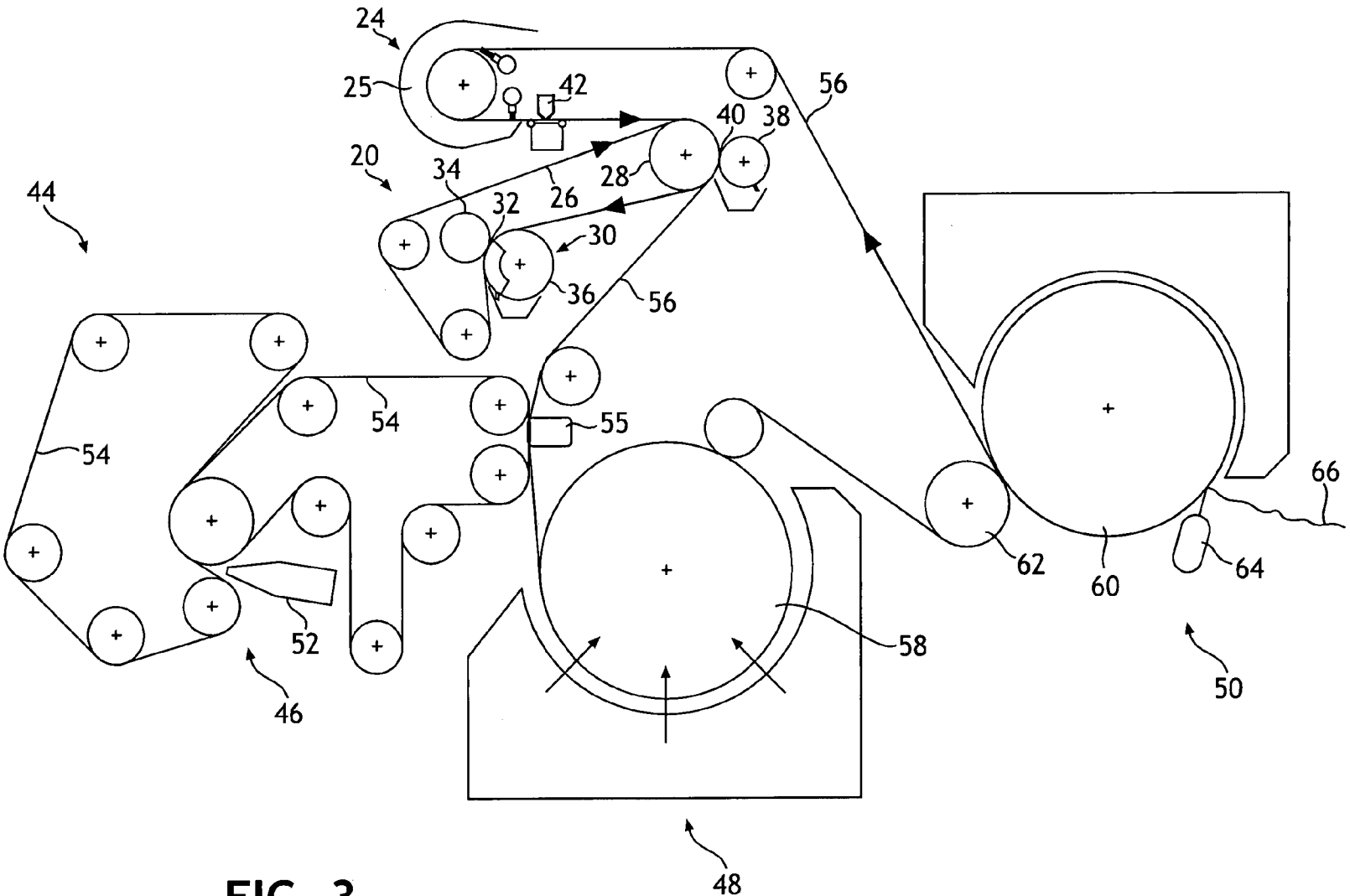
FIG. 3 illustrates a paper machine using the fabric dewatering apparatus of FIG. 1.

Referring now to FIG. 3, the fabric dewatering apparatus 20 is shown installed in one possible location in a paper machine 44. As mentioned, the dewatering apparatus can be used on any desired fabric in the paper machine, but will ordinarily be used on the fabric that transports the paper web through the dryer. Furthermore, use of the dewatering apparatus is not limited to the specific paper machine shown as it can be used with any type of paper machine.

In general, the paper machine includes a forming section 46, a drying section 48, and a creping section 50. The forming section includes a headbox 52 and one or more forming fabrics 54. After formation, the tissue web is transferred by a transfer shoe 55 to a dryer fabric 56 that carries the tissue web through a through air dryer 58. The through air dryer is used to dry the tissue web to its final consistency prior to being creped.

The dryer fabric 56, after being cleaned by a flooded nip shower and dewatered by conventional equipment, such as an air knife, can carry on the order of approximately 10 gsm to about 80 gsm of water into the through air dryer 58. A typical paper web entering the through air dyer, after being formed and dewatered by vacuum boxes, can have approximately 20 gsm of fiber and 60 gsm of retained water. Thus, for some paper machines, the dryer load imposed by the retained water in the dryer fabric can be a significant portion of the total energy used to dry the paper web. Reducing the amount of retained water in the dryer fabric 56 can save a significant amount of energy per year or allow for a significant increase in speed for paper machines that are dryer limited.

After being through air dried, the paper web is applied to a Yankee dryer 60 by a pressure roll 62. The paper web is then creped off of the surface of the Yankee dryer by a creping blade 64 to form a creped tissue web 66. The dryer fabric 56 is then sent through the flooded nip shower 25 to remove residual fibers and creping chemicals that are sprayed onto the Yankee dryer to adhere the tissue web to the dryer's surface. The dryer fabric 56 is then dewatered by the fabric dewatering apparatus 20 of FIG. 1. After being dewatered, the dryer fabric 56 is advanced to the transfer shoe 55 to begin its cycle again.

Experimental Fabric Dewatering Test Results

To test the ability of a felt to dewater a fabric, several bench tests were conducted. A WeaveXX Millennium 1C felt sample, with chemical resistant B treatment, available from WeaveXX Corporation of Westborough, Mass., having an area of approximately 30 $in^2$ (6.75 inch by 4.5 inch) was utilized. The felt sample had the following approximate properties: A finished weight of 4.58 $oz/ft^2$, a caliper of 0.102 inches, a permeability of 18.1 cfm (per square foot of sample tested at 0.5 inches water column), and a needle code of 0412-T1T3T4. The first substrate layer was composed of 15 denier yarns that weighed about 85 gsm. The second substrate layer was composed of a 6/15 denier mix that weighed about 255 gsm. The cap layer was composed of 3 denier yarns that weighed 20 about 300 gsm.

A TissueMax M fabric sample available from Voith Paper Fabrics, Forming Fabric Division, 3040 Blackcreek Rd., Wilson, N.C. 27893, having an area of approximately 30 $in^2$ (6.75 inch by 4.5 inch) was used for the fabric sample in the dewatering experiments. The fabric was stacked on top of the felt by aligning all four edges of each sample. A thin sheet of film, such as a clear overhead transparency sheet, was then placed over the fabric sample. Prior to conducting each test, the dry weights of the felt and fabric samples were recorded. Then the fabric and/or felt samples were wetted to the indicated moisture content by uniformly spraying the surface of each with water. The wet weights of the felt and fabric samples were recorded. For the wetted felt samples, the felt was saturated to approximately 100% moisture content by spraying with about 30 grams of water. For the fabric samples, the moisture content was varied as shown in Table 1.

Shortly after wetting the felt and fabric samples, the felt was placed on a moisture impermeable surface, the fabric sample stacked directly on top of the felt, the moisture impermeable film placed over the fabric, and a weight was placed onto the stack for approximately 1 sec. The weight was then removed and the final weight of the fabric sample was recorded. The weight weighed approximately 8.8 lbs and loaded the fabric into the felt at approximately 0.3 psi, a loading pressure less than or equal to a possible loading pressure in a commercial situation utilizing only the fabric's tension to bring the fabric and felt into surface contact.

For each test, the percent water removed was determined by subtracting the 10 fabric's final weight from the initial wet weight and then dividing the result by the initial wet weight. Table 1 shows the results obtained by various retained moisture levels of the fabric and using either a pre-moistened or bone dry felt.

TABLE 1

| Initial Fabric Moisture (grams/gsm) | Bone Dry Felt (0% moisture) Water Water Removal (g/gsm/percent) | Wet Felt (100% moisture) Water Removal (g/gsm/percent) |
|---|---|---|
| 1.41/71 | 0.06/3.0/4 | |
| 1.87/94 | 0.11/5.5/6 | |
| 2.41/121 | 0.31/15.5/13 | |

TABLE 1-continued

| Initial Fabric Moisture (grams/gsm) | Bone Dry Felt (0% moisture) Water Water Removal (g/gsm/percent) | Wet Felt (100% moisture) Water Removal (g/gsm/percent) |
|---|---|---|
| 3.07/154 | 0.41/20.5/13 | |
| 1.77/89 | | 0.13/6.5/7 |
| 1.89/95 | | 0.44/22/23 |
| 2.32/116 | | 0.29/19.5/17 |
| 2.43/122 | | 0.58/29/24 |
| 2.61/131 | | 0.77/38.5/30 |
| 2.84/142 | | 1.01/50.5/36 |
| 3.44/172 | | 0.91/45.5/27 |

As seen in Table 1, a wicking substrate 26, such as a felt, is an effective means for removing water from a fabric, without consuming an appreciable amount of energy. Additionally, a moist or wet felt was more effective in removing water from the fabric sample than a bone dry felt. Also as illustrated in the table, the wet felt was more effective in removing water from the fabric when the fabric contained higher amounts of water. Thus, the fabric dewatering apparatus 20 may be better suited to being located immediately after the flooded nip shower 25 to remove water from the fabric when it is at its highest amount. If additional water removal is needed, an air knife, vacuum box, or other device can be located after the dewatering apparatus.

In various embodiments of the invention, the dewatering apparatus 20 can be used to remove greater than about 10 gsm, about 25 gsm, about 35 gsm, or about 45 gsm of the showering water from the fabric 22. In various embodiments of the invention, the dewatering apparatus can be used to remove between about 10 gsm to about 70 gsm, or between about 20 gsm to about 70 gsm, or between about 30 gsm to about 70 gsm of the showering water. In various embodiments of the invention, the dewatering apparatus 20 can be used to remove at least 15 percent, at least 25 percent, or at least 35 percent of the showering water from the fabric. In various embodiments of the invention, the dewatering apparatus 20 can be used to remove between about 15 percent to about 50 percent, or between about 25 percent to about 50 percent, or between about 35 percent to about 50 percent of the showering water.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

We Claim:

1. A fabric dewatering apparatus for use after a fabric cleaning apparatus in a paper machine comprising:

at least one endless wicking substrate disposed for rotation about a dryer roll;

the endless wicking substrate and the fabric brought into surface contact as the fabric traverses at least a portion of the dryer roll's circumference; and a wicking substrate dewatering apparatus disposed along the wicking substrate's travel path after the dryer roll.

2. The fabric dewatering apparatus of claim 1 wherein the endless wicking substrate is a felt.

3. The fabric dewatering apparatus of claim 2 wherein the wicking substrate dewatering apparatus comprises a felt pressure roll nipped with a felt vacuum roll, and the felt is disposed in the pressure roll nip between the felt pressure roll and the felt vacuum roll.

4. The fabric dewatering apparatus of claim l wherein the endless wicking substrate is a capillary membrane.

5. The fabric dewatering apparatus of claim 1 comprising an air knife located adjacent to the fabric.

6. The fabric dewatering apparatus of claim 5 wherein the air knife is disposed after the fabric dewatering apparatus relative to the fabric's travel path.

7. The fabric dewatering apparatus of claim 1 comprising a fabric pressure roll nipped with the drying roll, and the fabric is disposed in a fabric nip between the fabric pressure roll and the dryer roll.

8. The fabric dewatering apparatus of claim 1 wherein the fabric wraps the dryer roll and the wrap angle is between about 10 degrees to about 270 degrees.

9. The fabric dewatering apparatus of claim 1 wherein the paper machine comprises a through air dryer and a dryer fabric wrapping a portion of the through air dryer, and the fabric dewatering apparatus dewaters the dryer fabric after being cleaned by at least one cleaning shower disposed after the through air dryer relative to the dryer fabric's travel path.

10. The fabric dewatering apparatus of claim 9 wherein the dryer fabric also wraps at least a portion of a pressure roll nipped against a Yankee dryer; and the at least one cleaning shower and the fabric dewatering apparatus are disposed after the pressure roll relative to the dryer fabric's travel path.

11. The fabric dewatering apparatus of claim 1 wherein greater than about 15 gsm of the showering water is removed from the fabric.

12. The fabric dewatering apparatus of claim 1 wherein at least 15 percent of the showering water is removed from the fabric.

13. The apparatus of claim 1 wherein the felt contacts the surface of the drying roll.

14. The apparatus of claim 1 wherein the fabric contacts the surface of the drying roll.

15. A fabric dewatering apparatus for use after a fabric cleaning apparatus in a paper machine comprising:

an endless first wicking substrate wrapped about a first dryer roll;

an endless second wicking substrate wrapped about a second dryer roll, said second dryer roll forming a nip with the first dryer roll such that the first and second wicking substrates are positioned within the nip;

a fabric disposed in the nip between the two wicking substrates; and a wicking substrate dewatering apparatus disposed along the wicking substrates' travel path after the dryer rolls.

16. The fabric dewatering apparatus of claim 15 wherein both endless wicking substrates comprise felts, and the both felts are dewatered by a felt pressure roll nipped with a felt vacuum roll.

17. The fabric dewatering apparatus of claim 15 wherein the fabric traverses an S-wrap about the two nipped dryer rolls.

18. The fabric dewatering apparatus of claim 15 wherein the endless wicking substrates are capillary membranes.

19. The fabric dewatering apparatus of claim 15 comprising an air knife located adjacent to the fabric.

20. The fabric dewatering apparatus of claim 19 wherein the air knife is disposed after the fabric dewatering apparatus relative to the fabric's travel path.

21. The fabric dewatering apparatus of claim 15 wherein the paper machine comprises a through air dryer and a dryer fabric wrapping a portion of the through air dryer, and the fabric dewatering apparatus dewaters the dryer fabric after being cleaned by at least one cleaning shower disposed after the through air dryer relative to the dryer fabric's travel path.

22. The fabric dewatering apparatus of claim 21 wherein the dryer fabric also wraps at least a portion of a pressure roll nipped against a Yankee dryer; and the at least one cleaning shower and the fabric dewatering apparatus are disposed after the pressure roll relative to the dryer fabric's travel path.

23. The fabric dewatering apparatus of claim 15 wherein greater than about 15 gsm of the showering water is removed from the fabric.

24. The fabric dewatering apparatus of claim 15 wherein at least 15 percent of the showering water is removed from the fabric.

* * * * *